US006729165B2

(12) United States Patent
Hsu

(10) Patent No.: US 6,729,165 B2
(45) Date of Patent: May 4, 2004

(54) HEATING APPARATUS IN A COLOR TEST MACHINE

(76) Inventor: Min-Chung Hsu, Lot D, Kuandu Apt., 8F, No. 10, Lane 33, Minzu Road, Zhuwei, Danshui Chen, Taipei Hsien (TW)

( * ) Notice: Subject to any disclaimer, the term of this patent is extended or adjusted under 35 U.S.C. 154(b) by 173 days.

(21) Appl. No.: 09/915,506

(22) Filed: Jul. 27, 2001

(65) Prior Publication Data

US 2002/0144524 A1 Oct. 10, 2002

(30) Foreign Application Priority Data

Apr. 9, 2001 (TW) ..... 90205431 U
Jul. 2, 2001 (TW) ..... 90205431A01 U

(51) Int. Cl.[7] ..... D06C 7/00; F27B 15/00
(52) U.S. Cl. ..... 68/12.07; 68/15; 68/139; 432/197

(58) Field of Search ..... 68/12.07, 15, 16, 68/139; 432/103, 112, 197

(56) References Cited

U.S. PATENT DOCUMENTS 4,597,737 A * 7/1986 Raghavan et al. ..... 432/197
6,117,192 A * 9/2000 Tate ..... 8/611
6,158,501 A * 12/2000 Koivukunnas ..... 165/89

* cited by examiner

*Primary Examiner*—Frankie L. Stinson
*Assistant Examiner*—Joseph L. Perrin
(74) *Attorney, Agent, or Firm*—Troxell Law Office PLLC

(57) ABSTRACT

A heating apparatus in a color test machine comprises a rotary tumbler seat, a rotating shaft for turning the rotary tumbler seat, a heater for heating the rotary tumbler seat, and tumbler recesses provided in the rotary tumbler. It is characterized in that solid micro particles are used as heat transfer media for heating and preserving the heat.

5 Claims, 5 Drawing Sheets

HEATING APPARATUS IN A COLOR TEST MACHINE

BACKGROUND OF THE INVENTION

1. Field of the Invention

The present invention relates to a heating apparatus in a color test machine, and, more particularly, to an improvement on a heating apparatus in a color test machine, with which the test tumbler can be heated up and preserve the heat quickly to shorten the time duration needed for performing the color dyeing in the color test machine.

2. Description of Related Art

Usually, a color test is a required lead operation of a dye work for a yarn or a cloth. It is necessary for a small amount of cloths or yarns to be tested the color dyed prior to a mass production of dyeing being performed in spite of cloths or yarns in order to make sure a correct color being dyed. Thus, it is preferable that the color test for a small amount of cloths or yarns is performed under a condition identical with that for the mass production of dyeing.

A mass production of dyeing is processed in a closed system so that the temperature in the closed system is in a state of steadiness and the color dyed for all the cloths or the yarns is identical in the same lot. However, it is a challenge for a color test machine to simulate the treatment condition in the mass production of dyeing. Especially, the color test machine has to treat a variety of materials with different colors at the same time so that it is a difficult problem to maintain a preset temperature.

The heating apparatus provided in the conventional color test machine usually adopts the oil as the medium for transferring the heat, that is, the oil is filled in the color test machine at lower part thereof and the oil is heated up by way of a heater to maintain a constant temperature. A rotary shaft is mounted at the upper part of the color test machine and in conjunction with the test tumbler containing dyeing stuff and dyed samples such as cloths or yarns. As soon as the rotary shaft rotates, the test tumbler below the rotary shaft may immerge in the heated oil and the heat may transmit to the test tumbler. The procedure is kept circulated sequentially to perform the color test job.

However, There are deficiencies existing in the conventional heating apparatus applied in the color test machine. Usually, it is slow for the oil to be heated up and the oil being heated to a preset temperature requires a period of time. A bad smell may generate as soon as the oil is heated up and the bad smell may affect the air of the work site. It is serious that the cooling speed is slow so that it takes a long waiting time for the operator before the test tumbler can be taken out. Besides, the tumbler contacts with the oil directly so that the outer side of the test tumbler has to be cleaned up after completing the color test.

SUMMARY OF THE INVENTION

An object of the present invention is to provide a heating apparatus in a color test machine, in which the heat transfer medium is made of sand material so that heating and the heat preservation can be reached quickly to shorten the time duration needed by the process of dyeing.

Another object of the present invention is to provide a heating apparatus in a color test machine, which further offers a temperature measure device and an automatically controlled cooling system such that the test tumbler can be cooled down quickly and the temperature in the test machine can be measured precisely.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
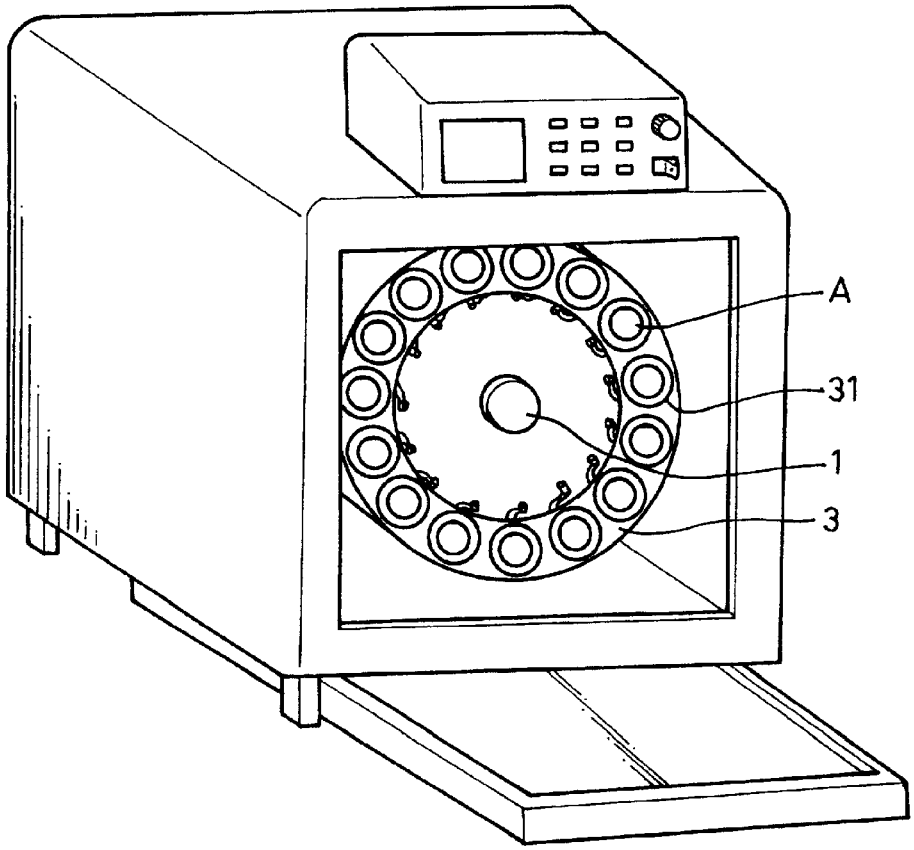
FIG. 1 is a perspective view of a heating apparatus in a color test machine according to the present invention.

Referring to FIG. 1, a color test machine according to the present invention basically provides a closed tank and comprises a rotating shaft 1, at least a heater 2 driven by the rotating shaft 1, and a rotary tumbler seat 3. In addition, a temperature reduction device 4 and a temperature measure device 5 may be added while the color test machine is in practice.

Wherein, the rotating shaft 1 is moved by way of a motor 11 via a belt 12 so that the rotating shaft 1 can turn with a constant speed. Because the rotating speed may affect the timing for a test tumbler contacting the heat transmitting medium, a speed limit device can be added to adjust the speed from the rotating shaft 1 such as the speed can be lowered down to 1 revolution per minute. Alternatively, the rotating shaft can be driven by a servomotor to provide an intermittent rotation so that the test tumbler can pause from time to time. However, this is a prior art and no detail will be described further.

The heater 2 may be a conventional electric heater, an electric light, or any other heating device. The heater 2 also belongs to the prior art and no detail will be described further too.

The rotary tumbler seat 3 basically is a disk viewed from the front side thereof and provides a plurality of tumbler recesses 31 around the periphery thereof for locating test tumblers A so that the inner diameter of each tumbler recess 31 is corresponding to the outer diameter of each test tumbler for the test tumbler tightly fitting with the tumbler recess. A recess clearance 33 is formed between each tumbler recess 31 and an outer wall 32 so that the tumbler recess 31 can communicate with the outer wall. A heat transfer medium 34 is received in the recess clearance 31 to guide the heat and it is preferably that the heat transfer medium 34 does not occupy the entire recess clearance 31.

Figure 2:
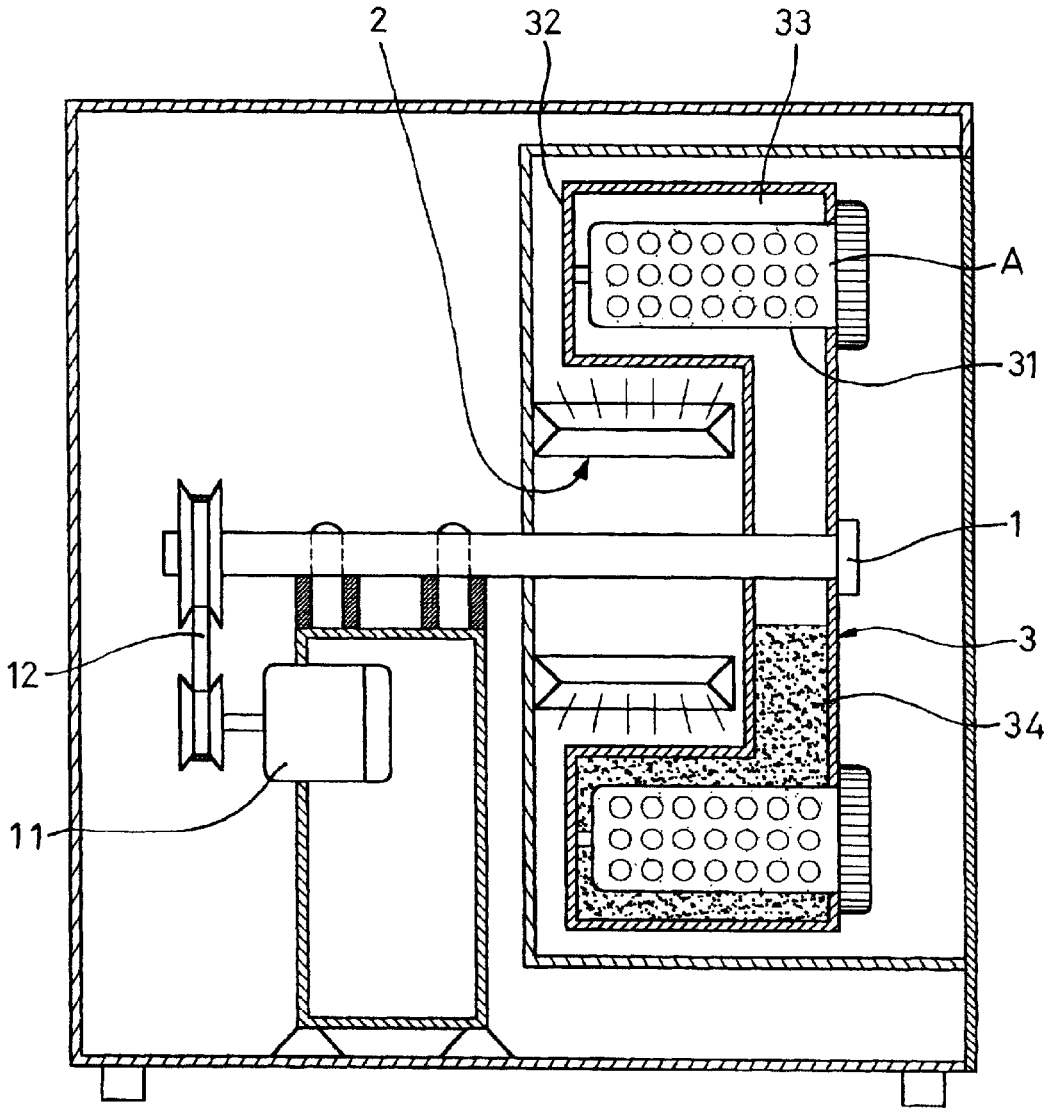
FIG. 2 is sectional view illustrating the heating apparatus in a color test machine according to the present invention in use.

Referring to FIG. 2, a greatest change of the heat guide medium 34 used in the present invention is that solid particles such as the sand material instead of the oil traditionally used. The sand material applied in the present invention is the natural sand such as the sand from the river, chemical micro particles, aluminum oxide, ceramic powder, magnesium oxide, or other micro particle materials such that an excellent effect with regard to the heat transfer and the heat preservation can be reached by the heat transfer medium 34. In the meantime, an excellent effect of the heat reduction and dissipation can be obtained substantially.

Referring to FIG. 2 again, as soon as the respective test tumbler A is inserted into the respective tumbler recess 31 and is closed in the color test machine, the rotating shaft 1 starts to rotate the color test machine and the respective heat transfer medium 34 in the respective recess clearance 33 may rotate along with the rotary tumbler seat 3. The test tumbler A may fall down during the rotation so as to be heated up and keep worm continuously by way of the heat transfer medium 34. In this way, the test tumbler A can obtain a uniform heat and maintain at a constant temperature due to the sand material, and the sample in the test tumbler can be dyed steadily.

As it has been mentioned above, the sand medium 34 is solid so that it is possible for the heat therein to be dissipated quickly with a reduction of temperature. Hence, the test tumbler A can be taken out shortly and the sample in the test tumbler A can be treated further with an check after the process of dying being complete with a stop heating due to a shorter cooling time.

Figure 3:
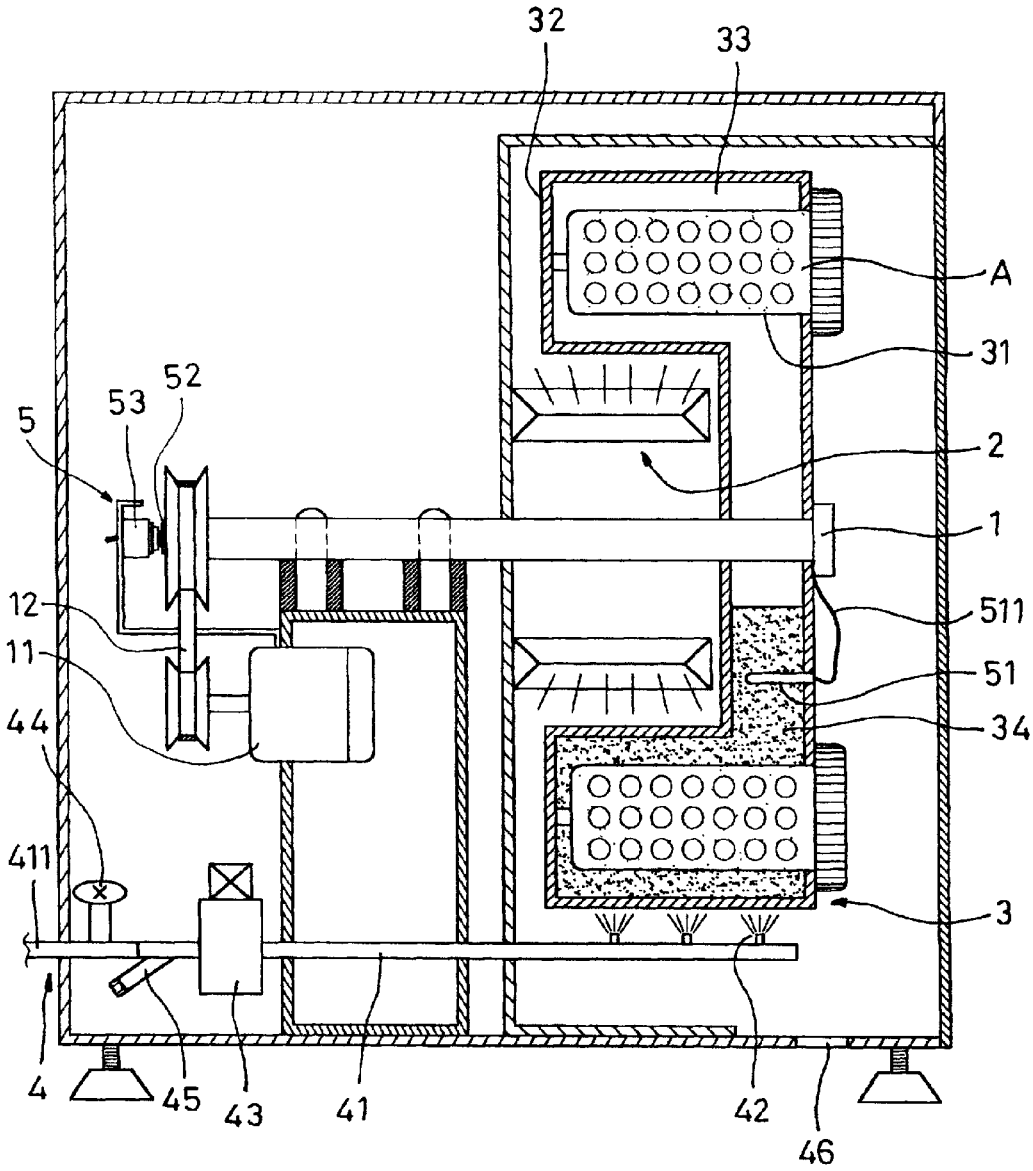
FIG. 3 is a sectional view illustrating the heating apparatus shown in FIG. 2 with an added temperature reduction device and a temperature measure device.

Referring to FIG. 3, the temperature reduction device 4 is disposed in the color test machine and further comprises a water inlet pipe 41, at least a nozzle head 42, an automatic switch 43, an inlet valve 44/or a filter 45.

Wherein, the water inlet pipe 41 is mounted in the test machine with an outward inlet end 411 for connecting the water source, and the other end of the inlet pipe 41 is disposed next to the rotary tumbler seat 3 with the nozzle head 42. The water passing through the nozzle head 42 can spray in a radial shape toward the rotary tumbler seat 3 to perform the cooling job after the process of dying.

The automatic switch 43 is connected to a programmable automatic device and the automatic switch 43 is in a state of being off during the process of dying and is tuned on automatically at the time of the temperature being reduced after the process of dying such that the water spraying can be started. Because the automatic switch 43 is a prior art, no detail will be described further.

The inlet valve 44 is disposed in the test machine too for controlling the admittance of the water, that is, the inlet valve 44 can be closed in case of no water being needed to avoid an excess of water supply. Besides, the filter 45 is placed before the automatic switch 43 to remove the foreign substance from the water for keeping the cleanness of the supply water.

Moreover, a water discharge hole 45 is provided at the bottom of the test machine to drain off the sprayed water after cooling and a pipeline can be connected to the water discharge hole 46 for the drained water flowing outward properly or being recycled. This part also belongs to the prior art and no further detail will be described.

Referring to FIG. 3 again, after the color test machine of the present invention having completed the process of dying, the rotary tumbler seat 3 still keeps in a state of rotating without heating and the automatic switch 43 is started so that the nozzle head 42 sprays the water to cool down the rotary tumbler seat 3 so as to shorten the time duration before the test tumbler A being possible to be taken out. The sprayed water then can be discharged through the water discharge hole 46.

Referring to FIG. 3 again, the rotary tumbler seat 3 is exposed in a closed space with high temperature and it is hard to measure the temperature thereof. Thus, the temperature measure device 5 is mounted for being feasible for the measurement of temperature.

Figure 4:
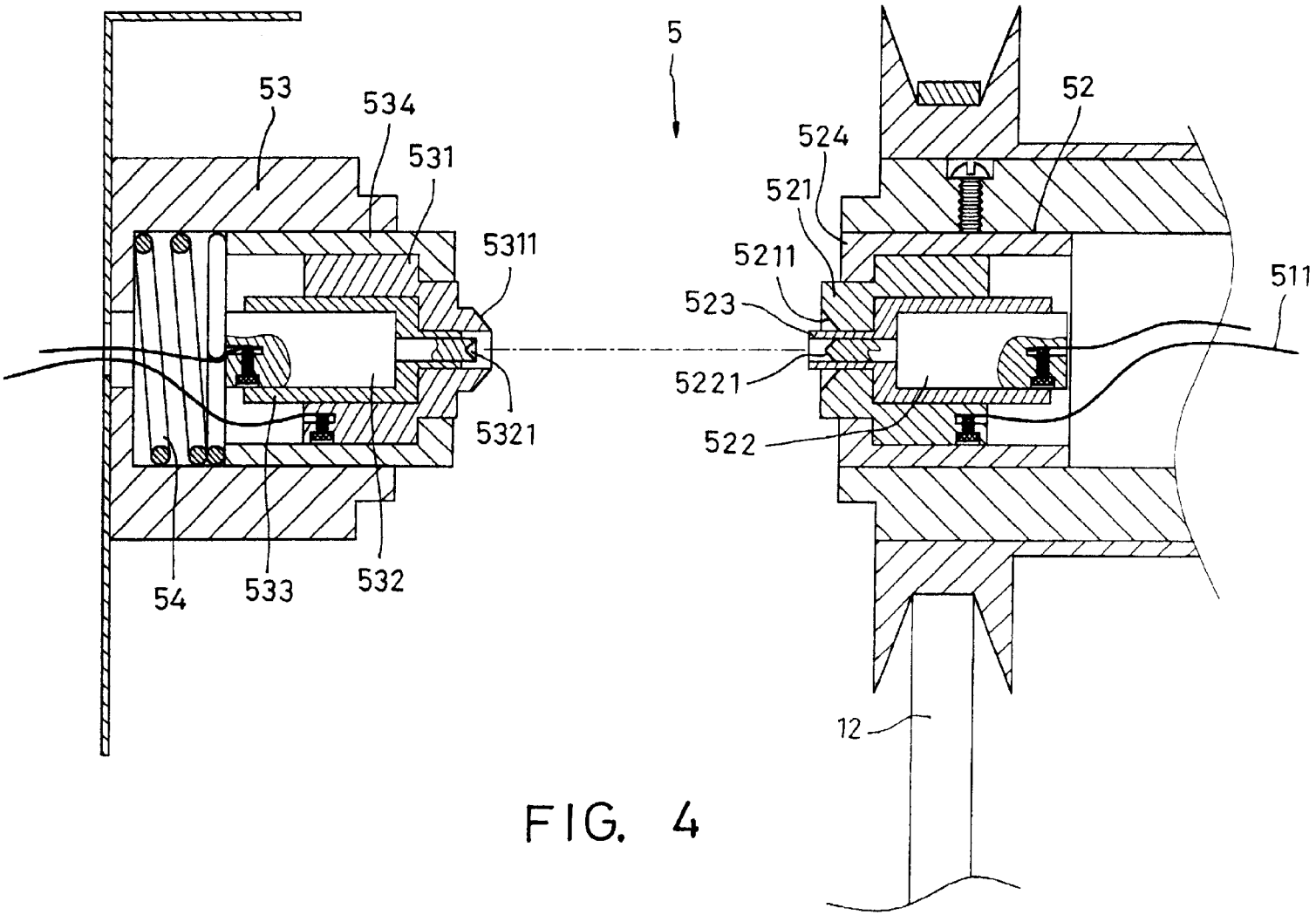
FIG. 4 is an exploded sectional view of the temperature measure device shown in FIG. 3.
Figure 5:
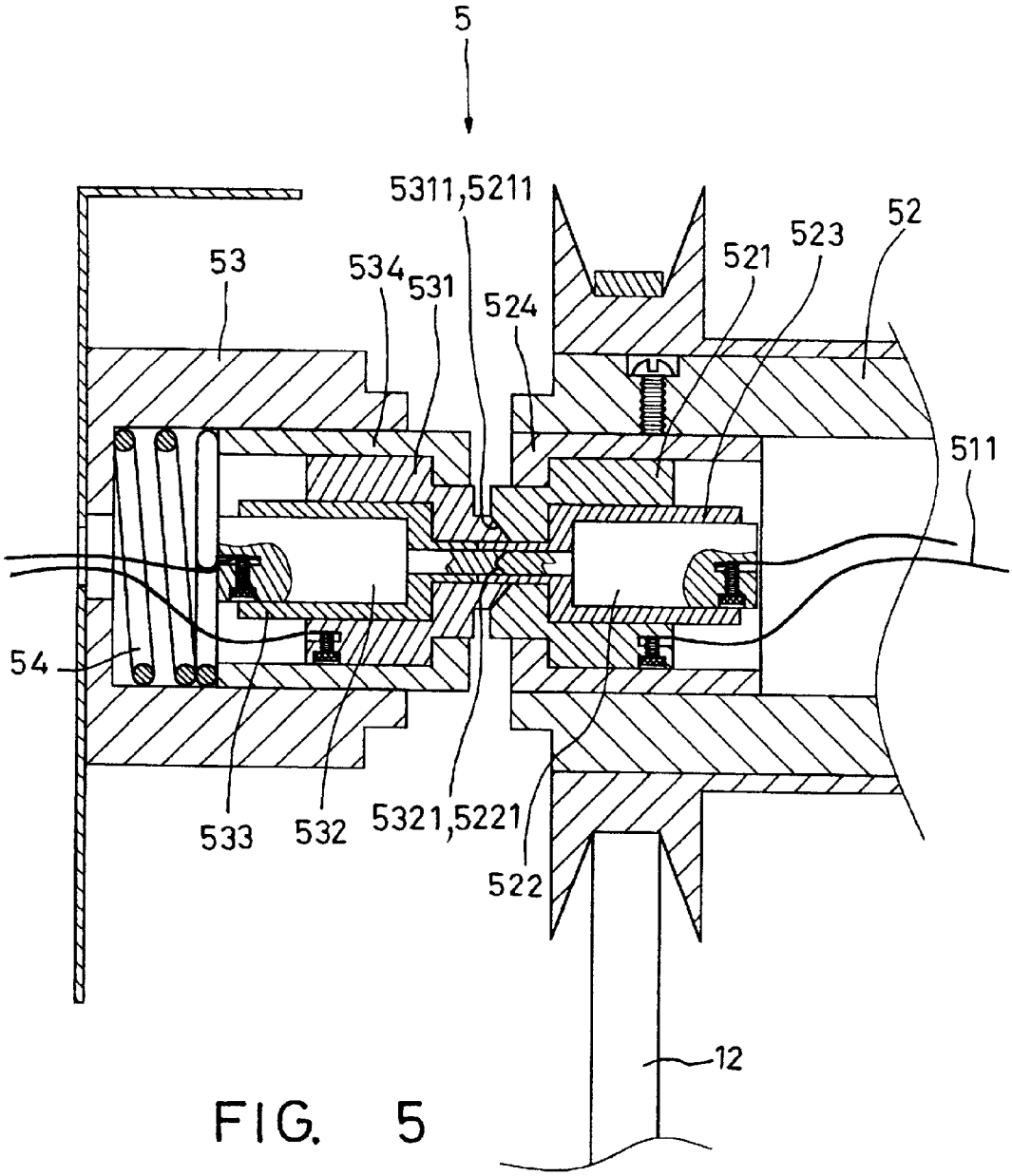
FIG. 5 is a sectional view illustrating the temperature measure device in a normal state of connecting.

Referring to FIGS. 4 and 5 with accompanying FIG. 3 again, the temperature measure device 5 basically comprises a feeler rod 51, a drive part 52, and a follower part 53. The feeler rod 51 electrically connects with the drive part 52 via wires, and the drive part 52 contacts with the follower part 53.

Wherein, the feeler rod 51 is disposed in and fixedly attached to the rotary tumbler seat 3 to sense the temperature in the rotary tumbler seat 3 with two sensing polar lines 511 passing through the rotating shaft 1.

The drive part 52 provides a shape of sleeve and is disposed in the rotating shaft 1 driven by the belt 12. The drive part 52 comprises an active polar cylinder 521 made of conductive material and an active polar shaft 522 and the two sensing polar lines 511 connect with the active polar cylinder 521 and the active polar shaft 522 respectively. An inner insulating cylinder 523 is disposed between the active polar cylinder 521 and the active polar shaft 522 to insulate the active polar cylinder 521 from the active polar shaft 522. An outer insulating cylinder 524 is disposed to surround the drive cylinder 521 to insulate from the inner wall of the rotating shaft 1. The active polar shaft 522 at the front end thereof is a sharp active polar end 5221 and the active polar cylinder 521 at the front end thereof is a flat surface with an inward recess 5211.

The follower part 53 is disposed corresponding to the drive part 52 and comprises a passive polar cylinder 531 and a passive polar shaft 532. An inner insulating cylinder 533 is provided between the passive polar cylinder 531 and the passive polar shaft 532 to constitute insulation in between. The passive cylinder 531 is surrounded with an outer insulating cylinder 534 to insulate from the rotating shaft 1. Besides, the passive polar cylinder 531 at the front end thereof provides an tilt passive polar slope 5311 corresponding to the drive polar recess 5211 obliquely. The passive polar shaft 532 at the front end thereof provides a passive polar recess 5321 corresponding to the drive polar end 5321 corresponding to drive polar end 5221. Furthermore, the passive polar cylinder 531 and the passive polar shaft 532 connect with a lead wire respectively.

In order to keep the drive part 52 contacting with the follower part 53 constantly, a spring is arranged at outside the follower part 53 to urge the follower part 53 against the drive part 52.

Referring to FIG. 5 again, the spring 54 urges the follower part 53 to move outward such that it results in the passive polar cylinder 531 and the passive polar recess 5321 keep a constant contact with the active polar cylinder 321 and the active polar end 5221, respectively. Hence, the two sensing polar lines 511 may be extended outward the test machine so that the feeler rod 51 may be in a close circuit.

It is appreciated from the preceding description that the advantages of the present invention can be summarized in the following:

(1) The present invention can enhance the safety. Due to the solid particles of sand material being applied to act as heat transfer medium, the undesirable effect with regard to the careless hurt resulting from heating oil and the explosion resulting from a great pressure as the conventional heater does can be avoided completely.

(2) The foul smell derived from the oil can be avoided. Because the sand material is used as the heat transfer medium, no odor would be spread out during heating so that it is not possible to produce the foul smell as the oil does. Hence, the working environment becomes better for the operators and the willingness for work and the efficiency during work can be enhanced greatly.

(3) It is not necessary to consider the problem of metamorphism in case of the medium being used repeatedly. The medium of sand material does not occur the chemical reaction during heating so that it can be reused again without the need for replacement. The oil used in the conventional heater easily becomes bad after heating and the old oil has to be replaced. Comparing to the oil, the medium of sand material can lower down the cost for processing the color test.

(4) It is possible to shorten the time during processing the operation of color test. Because the medium of sand material provides a better capability to perform the heat transfer, the functions such as heating, heat preservation, and heat reduction can be performed more quickly than the oil does. Hence, the speed and the efficiency for executing the color test can be promoted and the derived cost for carrying out the color test can be reduced.

(5) The sensed temperature is highly precise. Because the temperature sensing is conducted in the test machine and the temperature is read outside the test machine. Due to the temperature being measured in an airtight space, the accuracy of temperature sensing is enhanced greatly.

While the invention has been described with reference to a preferred embodiment thereof, it is to be understood that modifications or variations may be easily made without departing from the spirit of this invention, which is defined in the appended claims.

What is claimed is:

1. A heating apparatus in a color test machine, comprising:

a rotary tumbler seat;

a rotating shaft, turning the rotary tumbler;

a heater, heating the rotary tumbler seat; and a plurality of tumbler recesses, being provided in the rotary tumbler;

characterized in that a plurality of solid micro particles are used to constitute a plurality of heat transfer media for heating and preserving the heat.

2. The heating apparatus in a color test machine according to claim 1, wherein the solid micro particles are natural sands.

3. The heating apparatus in a color test machine according to claim 1, wherein the solid micro particles are selected from one of aluminum oxide powder, magnesium oxide powder, or the ceramic powder, or a mixture at least two of aluminum oxide powder, magnesium oxide powder, and the ceramic powder.

4. The heating apparatus in a color test machine according to claim 1, wherein the solid micro particles is received in a recess clearance between the respective tumbler and the rotary tumbler seat.

5. The heating apparatus in a color test machine according to claim 1, wherein an amount of the solid micro particles received in the recess clearance occupies a half of the recess clearance or less than a half of the recess clearance.

* * * * *